US007490920B2

(12) United States Patent
Usuda

(10) Patent No.: US 7,490,920 B2
(45) Date of Patent: Feb. 17, 2009

(54) METHOD OF DRIVING DROPLET JETTING HEAD, DROPLET JETTING APPARATUS, AND DEVICE MANUFACTURING METHOD

(75) Inventor: Hidenori Usuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 285 days.

(21) Appl. No.: 11/030,062

(22) Filed: Jan. 7, 2005

(65) Prior Publication Data

US 2005/0156967 A1 Jul. 21, 2005

(30) Foreign Application Priority Data

Jan. 21, 2004 (JP) ..... 2004-013029

(51) Int. Cl.
*B41J 2/165* (2006.01)
*B41J 29/393* (2006.01)

(52) U.S. Cl. ..... 347/23; 347/11; 347/19

(58) Field of Classification Search ..... 347/10
See application file for complete search history.

(56) References Cited

U.S. PATENT DOCUMENTS 5,548,308 A * 8/1996 Nagatomo et al. ..... 347/9
6,592,199 B2 7/2003 Endo
6,679,577 B2 * 1/2004 Du et al. ..... 347/23
6,761,423 B2 7/2004 Ozaki et al.
6,802,589 B2 * 10/2004 Yonekubo et al. ..... 347/29
6,908,174 B2 * 6/2005 Suzuki ..... 347/27

FOREIGN PATENT DOCUMENTS

| | | | |
|---|---|---|---|
| JP | A-06-143548 | | 5/1994 |
| JP | A-10-138513 | | 5/1998 |
| JP | 2002-079693 | A | 3/2002 |
| JP | A-2002-355984 | | 12/2002 |
| JP | 2003-118133 | A | 4/2003 |
| JP | A-2003-283102 | | 10/2003 |
| JP | 2005014335 | A * | 1/2005 |
| WO | WO 01/62498 | A1 | 8/2001 |

* cited by examiner

*Primary Examiner*—Luu Matthew
*Assistant Examiner*—Shelby Fidler
(74) *Attorney, Agent, or Firm*—Oliff & Berridge, PLC

(57) ABSTRACT

A method of driving a droplet jetting head having cavities for containing a predetermined liquid, piezoelectric elements, each for generating pressure in each cavity in accordance with an applied driving signal, and nozzle openings, from each of which the liquid compressed by each piezoelectric element is jetted as a droplet. The method includes driving the droplet jetting head by applying to one or more of the piezoelectric elements a forced jetting driving signal for forcedly jetting the liquid of half of an excluded volume, which is a maximum quantity removable from the cavity by compression using the piezoelectric element, from the nozzle opening. The clogged nozzle opening can be effectively cleared and clogging can be rapidly removed, so that the number of times for cleaning of the head is decreased and degradation in performance of the droplet jetting head, such as reduction in repellency of the liquid, does not occur.

10 Claims, 9 Drawing Sheets

METHOD OF DRIVING DROPLET JETTING HEAD, DROPLET JETTING APPARATUS, AND DEVICE MANUFACTURING METHOD

BACKGROUND OF THE INVENTION

1. Field of the Invention

The present invention relates to a method of driving a droplet jetting head for jetting droplets of a specific liquid, a droplet jetting apparatus including the droplet jetting head, and a device manufacturing method using the above method or the apparatus.

Priority is claimed on Japanese Patent Application No. 2004-013029, filed Jan. 21, 2004, the content of which is incorporated herein by reference.

2. Description of Related Art

Generally, a droplet jetting head provided in a droplet jetting apparatus includes a pressure generating chamber for containing a specific liquid, a piezo actuator for compressing the pressure generating chamber, and a nozzle opening communicated with the pressure generating chamber. The liquid in the pressure generating chamber is compressed by the piezo actuator, thereby jetting a small amount of liquid from the nozzle opening as a droplet. The liquid close to the nozzle opening directly contacts the outside air; thus, viscosity is increased due to the dry atmosphere. When the viscosity is increased, the nozzle opening is clogged, so that droplet jetting may not be satisfactorily performed.

In order to prevent substandard droplet jetting, flushing is performed regularly or irregularly in which droplets are forcedly jetted from the droplet jetting apparatus so as to discharge the thickened liquid (having high viscosity) outside the pressure generating chamber. When the substandard droplet jetting cannot be solved by flushing, attraction of the thickened liquid via the nozzle opening of the droplet jetting head is performed and then the surface of the nozzle plate is cleaned with a wiper. Examples of the known cleaning method are disclosed in the following documents: Japanese Unexamined Patent Application, First Publication Nos. 2002-079693 and 2003-118133.

As explained above, flushing is performed for preventing clogging of the droplet jetting head and cleaning is further performed when clogging occurs. If clogging still remains, flushing and cleaning are repeatedly performed. Therefore, the amount of liquid discharged from nozzles which are not clogged is increased and thus liquid is uselessly consumed. In addition, if cleaning is repeatedly performed and the plane in which the nozzle opening is formed is repeatedly wiped, the life of the wiper is reduced and water repellency of the plane in which the nozzle opening is formed is also reduced, thereby causing substandard droplet jetting.

Furthermore, recently, the droplet jetting apparatus is used for manufacturing various devices such as color filters or micro lens arrays used in liquid crystal display devices, or other devices having micro patterns. In addition, a plurality of droplet jetting heads are used for improving throughput (i.e., the number of devices which can be manufactured per unit time) to the utmost. Therefore, reduction of the throughput due to the clogging of the nozzle opening must be prevented as much as possible.

SUMMARY OF THE INVENTION

In consideration of the above circumstances, an object of the present invention is to provide (i) a method of driving a droplet jetting head and a droplet jetting apparatus for preventing clogging at the nozzle opening of the droplet jetting head, useless consumption of liquid, and degradation in performance of the droplet jetting head, and (ii) a device manufacturing method for manufacturing devices without causing reduction of throughput.

Therefore, the present invention provides a method of driving a droplet jetting head which has cavities for containing a predetermined liquid, piezoelectric elements, each for generating pressure in each cavity in accordance with an applied driving signal, and nozzle openings, from each of which the liquid compressed by each piezoelectric element is jetted as a droplet, the method comprising the step of:

driving the droplet jetting head by applying to one or more of the piezoelectric elements a forced jetting driving signal for forcedly jetting the liquid of half of an excluded volume from the nozzle opening, wherein the excluded volume is a maximum quantity removable from the cavity by compression using the piezoelectric element.

According to the above method, the liquid in the cavity is forcedly jetted by applying the forced jetting driving signal for jetting the liquid of half of the excluded volume from the nozzle opening; thus, it is possible to effectively clear the clogged nozzle opening of the droplet jetting head. In addition, clogging in the nozzle opening can be rapidly removed, thereby decreasing the number of times for cleaning of the droplet jetting head. Therefore, degradation in performance of the droplet jetting head, such as reduction in repellency of the liquid, does not occur. The excluded volume is a volume of the liquid removed from the cavity when the maximum pressure is applied to the cavity. In the above method, the quantity of the liquid jetted from the nozzle opening is not the entire excluded volume but half of the excluded volume. This is because the cavity is not enclosed except for the nozzle opening and thus the entire excluded volume cannot be jetted from the nozzle opening. Half of the excluded volume, which is not jetted from the nozzle opening, is removed from a portion other than the nozzle opening (e.g., from a supply inlet for supplying the predetermined liquid to the cavity).

Typically, the forced jetting driving signal is applied to the piezoelectric element corresponding to the nozzle opening from which no droplet is jetted. Accordingly, half of the excluded volume is jetted as droplets from that nozzle opening, and no droplets of the liquid is jetted from the nozzle opening from which droplets can be normally jetted, thereby preventing useless consumption of the liquid while removing the clogging of the nozzle opening.

The method may further comprise:

a detection step of detecting presence/absence of droplet jetting from each nozzle opening; and a control step of determining whether the forced jetting driving signal is applied to the piezoelectric element of each nozzle opening, according to detection results in the detection step.

In this case, presence/absence of droplet jetting from each nozzle opening is detected in advance, and application of the forced jetting driving signal to the piezoelectric element is controlled according to the detection results. Therefore, only when a problem in droplet jetting such as clogging in the nozzle opening is detected, droplets are jetted from the substandard nozzle opening so as to overcome the problem. According to the control, useless liquid jetting is not performed in comparison with, for example, a case of regular application of the forced jetting driving signal. Therefore, liquid consumption can be reduced and time necessary for droplet jetting when applying the forced jetting driving signal can also be reduced.

The above control step may include applying to the piezoelectric element to which the forced jetting driving signal is not applied, a micro driving signal for generating micro pressure by which no droplet is jetted from the corresponding nozzle opening. Accordingly, the micro driving signal is applied to the piezoelectric element corresponding to the nozzle opening from which droplets are normally jetted. Therefore, a meniscus portion at the nozzle opening is reciprocated, so that increase in viscosity of the liquid is prevented and thus clogging in the nozzle opening is prevented.

In addition, the control step may include:

generating a driving signal which includes the forced jetting driving signal and the micro driving signal in one jetting period; and selecting one of the forced jetting driving signal and the micro driving signal according to the detection results in the detection step, and applying the selected signal to the corresponding piezoelectric element.

In this case, a driving signal which includes the forced jetting driving signal and the micro driving signal in one jetting period of the droplet jetting head is generated, and one of the forced jetting driving signal and the micro driving signal is selected and applied to the corresponding piezoelectric element, according to the detection results in the detection step. Therefore, even when multiple piezoelectric elements are provided, a driving signal suitable for each piezoelectric element can be applied in a short time.

The control step may include controlling the number of times of application of the forced jetting driving signal to the piezoelectric element, in accordance with the kind of the predetermined liquid. Accordingly, the number of times of application of the forced jetting driving signal to the piezoelectric element, that is, the number of times of liquid jetting, is controlled in accordance with the kind of the predetermined liquid. Therefore, an appropriate quantity of the liquid can be jetted in accordance with, for example, susceptibility to dryness, viscosity, or the like, of the liquid, thereby effectively avoiding clogging of the nozzle opening.

The present invention also provides a method of driving a droplet jetting head which has piezoelectric elements, each for generating pressure in accordance with an applied driving signal, and nozzle openings, from each of which a liquid compressed by the pressure generated by each of the piezoelectric elements is jetted as a droplet, the method comprising:

a detection step of detecting presence/absence of droplet jetting from each nozzle opening; and a control step of determining whether a forced jetting driving signal for forcedly jetting the liquid from the nozzle opening is applied to the piezoelectric element of each nozzle opening, according to detection results in the detection step.

According to the above method, presence/absence of droplet jetting from each nozzle opening is detected in advance, and application of the forced jetting driving signal to the piezoelectric element is performed according to the detection results. Therefore, only when a problem in droplet jetting such as clogging in the nozzle opening is detected, droplets are jetted from the substandard nozzle opening. Accordingly, useless liquid jetting is not performed in comparison with, for example, a case of regular application of the forced jetting driving signal. Therefore, liquid consumption can be reduced and time necessary for droplet jetting when applying the forced jetting driving signal can also be reduced.

The control step may include applying to the piezoelectric element to which the forced jetting driving signal is not applied, a micro driving signal for generating micro pressure by which no droplet is jetted from the corresponding nozzle opening. Accordingly, the micro driving signal is applied to the piezoelectric element corresponding to the nozzle opening from which droplets are normally jetted. Therefore, a meniscus portion at the nozzle opening is reciprocated, so that increase in viscosity of the liquid is prevented and thus clogging in the nozzle opening is prevented.

In this case, the control step may includes:

generating a driving signal which includes the forced jetting driving signal and the micro driving signal in one jetting period; and selecting one of the forced jetting driving signal and the micro driving signal according to the detection results in the detection step, and applying the selected signal to the corresponding piezoelectric element.

Accordingly, a driving signal which includes the forced jetting driving signal and the micro driving signal in one jetting period of the droplet jetting head is generated, and one of the forced jetting driving signal and the micro driving signal is selected and applied to the corresponding piezoelectric element, according to the detection results in the detection step. Therefore, even when multiple piezoelectric elements are provided, a driving signal suitable for each piezoelectric element can be applied in a short time.

The control step may include controlling the number of times of application of the forced jetting driving signal to the piezoelectric element, in accordance with the kind of the predetermined liquid. Accordingly, the number of times of application of the forced jetting driving signal to the piezoelectric element, that is, the number of times of liquid jetting, is controlled in accordance with the kind of the predetermined liquid. Therefore, an appropriate quantity of the liquid can be jetted in accordance with, for example, susceptibility to dryness, viscosity, or the like, of the liquid, thereby effectively avoiding clogging of the nozzle opening.

The present invention also provides a droplet jetting apparatus having a droplet jetting head which includes cavities for containing a predetermined liquid, piezoelectric elements, each for generating pressure in each cavity in accordance with an applied driving signal, and nozzle openings, from each of which the liquid compressed by each piezoelectric element is jetted as a droplet, the apparatus comprising:

a driving signal generating unit for generating a forced jetting driving signal for forcedly jetting the liquid of half of an excluded volume from the nozzle opening, wherein the excluded volume is a maximum quantity removable from the cavity by compression using the piezoelectric element.

According to the above apparatus having the driving signal generating unit for generating the forced jetting driving signal for forcedly jetting the liquid of half of the excluded volume from the nozzle opening, it is possible to effectively clear the clogged nozzle opening of the droplet jetting head by applying the generated forced jetting driving signal to the piezoelectric element. In addition, clogging in the nozzle opening can be avoided, thereby decreasing the number of times of cleaning of the droplet jetting head. Therefore, degradation in performance of the droplet jetting head, such as reduction in repellency of the liquid, does not occur.

The droplet jetting apparatus may further comprise:

a detection device for detecting presence/absence of droplet jetting from each nozzle opening; and a control unit for determining to which piezoelectric element the forced jetting driving signal is applied, according to detection results by the detection device.

presence/absence of droplet jetting from each nozzle opening is detected by using the detection device, and the control unit determines to which piezoelectric element the forced jetting driving signal is applied, according to detection results by the detection device. Therefore, only when a problem in droplet jetting (i.e., a problem in which droplets are not jetted)

is detected, droplets are jetted from the substandard nozzle opening so as to overcome the problem, thereby reducing liquid consumption.

Preferably, the driving signal generating unit generates a driving signal which includes the forced jetting driving signal and a micro driving signal for generating micro pressure by which no droplet is jetted. In this case, the control unit may select one of the forced jetting driving signal and the micro driving signal according to the detection results by the detection device, and apply the selected signal to the corresponding piezoelectric element.

Accordingly, the forced jetting driving signal is applied to the piezoelectric element corresponding to the nozzle opening having a fault in droplet jetting, while the micro driving signal is applied to the piezoelectric element corresponding to the nozzle opening having no fault in droplet jetting. Therefore, substandard jetting can be prevented and increase in viscosity of the liquid at the nozzle opening can also be prevented.

The present invention also provides a droplet jetting apparatus having a droplet jetting head which has piezoelectric elements, each for generating pressure in accordance with an applied driving signal, and nozzle openings, from each of which a liquid compressed by the pressure generated by each of the piezoelectric elements is jetted as a droplet, the method comprising:

a detection device for detecting presence/absence of droplet jetting from each nozzle opening; and a control unit for determining to which piezoelectric element a forced jetting driving signal for forcedly jetting the liquid from the nozzle opening is applied to, according to detection results by the detection device.

According to the above apparatus, presence/absence of droplet jetting from each nozzle opening is detected in advance, and application of the forced jetting driving signal to the piezoelectric element is controlled according to the detection results. Therefore, only when a problem in droplet jetting such as clogging in the nozzle opening is detected, droplets are jetted from the substandard nozzle opening so as to overcome the problem. Accordingly, useless liquid jetting is not performed in comparison with, for example, a case of regular application of the forced jetting driving signal. Therefore, liquid consumption can be reduced and time necessary for droplet jetting when applying the forced jetting driving signal can also be reduced.

The present invention also provides a device manufacturing method for manufacturing a device which includes a work on which a functional pattern is formed in a predetermined area, the method comprising:

a preliminary jetting step performed using any one of the methods as explained above or using any one of the apparatuses as explained above, wherein the predetermined liquid is jetted from each nozzle opening of the droplet jetting head; and a pattern forming step of forming the pattern on the work by jetting the droplets by using the droplet jetting head which was subjected to the preliminary jetting step.

According to the above device manufacturing method, clogging in the nozzle opening is avoided or prevented by using any one of the above-explained methods of driving a droplet jetting head or any one of the above-explained droplet jetting apparatuses, and the pattern is formed on the work by jetting the droplets by using the droplet jetting head which was subjected to the preliminary jetting step. Therefore, useless liquid consumption can be prevented and longer time for jetting droplets for pattern formation can be secured. Accordingly, the cost for manufacturing devices can be reduced and the throughput can be improved.

BRIEF DESCRIPTION OF THE DRAWINGS

FIG. 7A shows the normal driving signal and the forced jetting driving signal, and FIG. 7B shows the excluded volume.

DETAILED DESCRIPTION OF THE INVENTION

Hereinafter, the method of driving a droplet jetting head and the droplet jetting apparatus, and the device manufacturing method, as embodiments according to the present invention, will be explained in detail with reference to the drawings.

Droplet Jetting Apparatus

Figure 1:
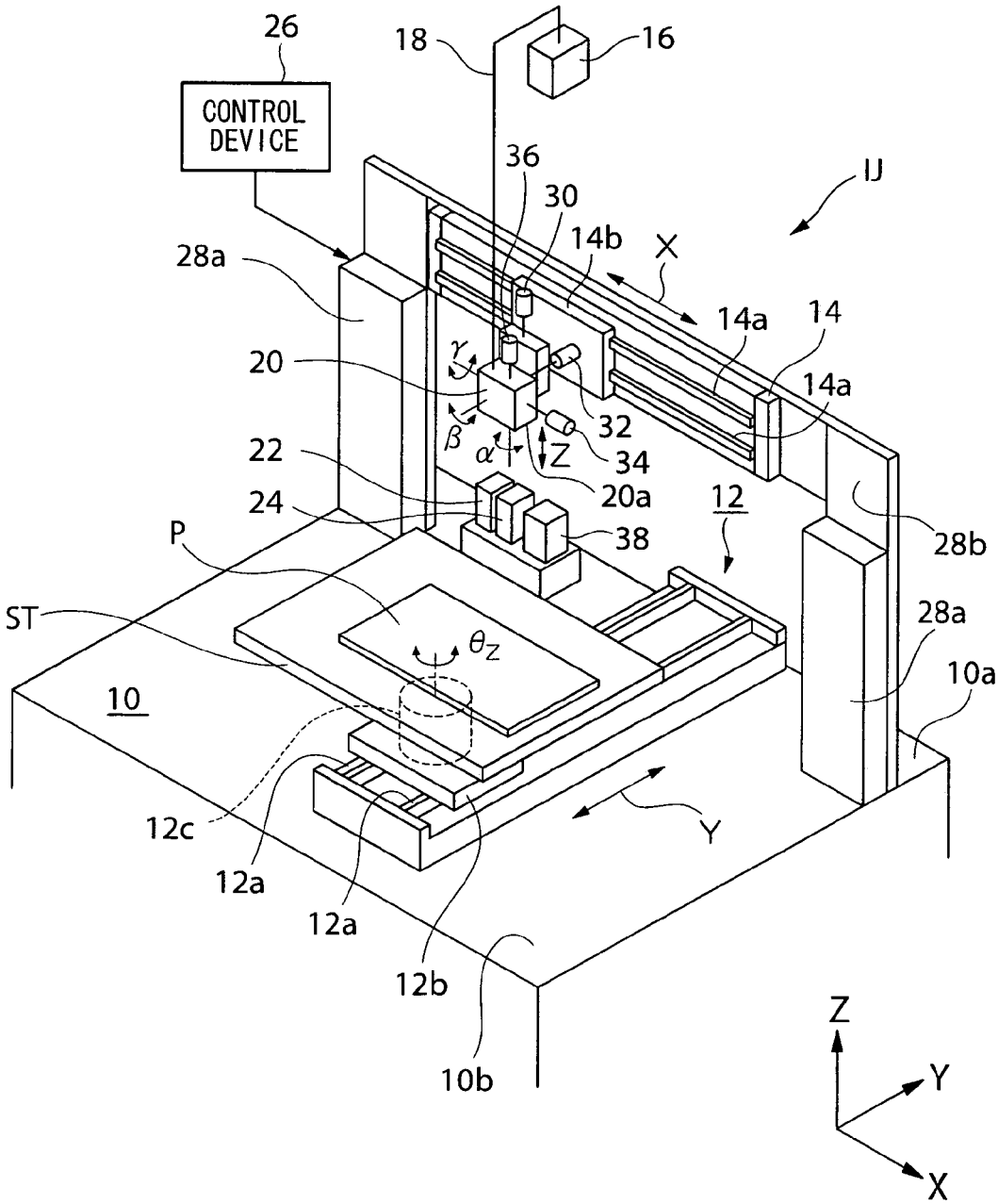
FIG. 1 is a perspective view showing the general structure of the droplet jetting apparatus as an embodiment of the present invention.

FIG. 1 is a perspective view showing the general structure of the droplet jetting apparatus as an embodiment of the present invention. In the following explanation, the XYZ orthogonal coordinate system is provided in the drawings where necessary, and the positional relationships between members are explained with reference to the XYZ orthogonal coordinate system. In the XYZ orthogonal coordinate system, the XY plane is defined as a plane parallel to the horizontal plane and the Z axis is defined in the upward vertical direction. In the present embodiment, the moving direction of the jet head (i.e., droplet jetting head) 20 is defined as the X direction, and the moving direction of the stage ST is defined as the Y direction.

As shown in FIG. 1, the droplet jetting apparatus IJ of the present embodiment has a base 10, a stage ST for supporting a substrate P, such as a glass substrate, on the base 10, and a jet head 20 which can jet specific droplets towards the substrate P. Between the base 10 and the stage ST, a first moving device 12 is provided for supporting the stage ST in a manner such that the stage ST can move in the Y direction. Above the stage ST, a second moving device 14 is provided for supporting the jet head 20 in a manner such that the jet head 20 can move in the X direction.

A tank 16 is connected via a passage 18 to the jet head 20. The tank 16 contains droplets of a solvent (i.e., a predetermined liquid) which are jetted from the jet head 20. On the base 10, a capping unit 22 and a cleaning unit 24 are provided. The control device 26 controls each portion of the droplet jetting apparatus IJ (e.g., the first moving device 12, the second moving device 14, and the like), thereby controlling the entire operation of the droplet jetting apparatus IJ.

The first moving device 12 is provided on the base 10 and the position of this moving device is determined along the Y axis. This first moving device 12, which may be realized using a linear motor, has guide rails 12*a* and 12*a*, and a slider 12*b* which can be moved along the guide rails 12*a* and 12*a*. The slider 12*b* of the first moving device 12 which employs a linear motor function can be positioned while moving in the Y direction along the guide rails 12*a* and 12*a*.

The slider 12*b* has a motor 12*c* for the action around the Z axis (i.e., θz). The motor 12*c* may be a direct drive motor, and the rotor of the motor is fixed to the stage ST. Accordingly, when the motor 12*c* is energized, the rotor and the stage ST rotate along the θz direction so that the stage ST can be indexed, that is, the quantity of rotation can be determined. Therefore, the first moving device 12 can move the stage ST in the Y axis and θz directions. The stage ST holds the substrate P and positions the substrate at a specific position. The stage St also has an attracting and holding device (not shown). When the attracting and holding device is activated, the substrate P is attracted and fastened to the stage ST via attraction holes (not shown) provided in the stage ST.

The second moving device 14 is attached to the base 10 via supports 28*a* and 28*a* in a manner such that the second moving device 14 stands on the rear portion 10*a* of the base 10. The second moving device 14 has a linear motor and is supported by the columns 28*b* fastened to the supports 28*a* and 28*a*. The second moving device 14 also has guide rails 14*a* and 14*a* supported by the columns 28*b* and a slider 14*b* which is supported in a manner such that the slider can move in the X direction along the guide rails 14*a* and 14*a* so as to position the slider. The above jet head 20 is attached to the slider 14*b*.

The jet head 20 includes motors 30, 32, 34, and 36 which function as a reciprocating positioning device. The jet head 20 can be moved upward and downward in the Z direction by driving the motor 30 and can be positioned at any position in the Z direction. The jet head 20 can be reciprocated along the β direction around the Y axis by driving the motor 32, thereby adjusting the angle of the jet head 20. The jet head 20 can be reciprocated along the γ direction around the X axis by driving the motor 34, thereby also adjusting the angle of the jet head 20. The jet head 20 can be reciprocated along the α direction around the Z axis by driving the motor 36, thereby also adjusting the angle of the jet head 20.

As explained above, the jet head 20 in FIG. 1 is supported by the slider 14*b* in a manner such that the head can be linearly moved in the Z direction and the angle of the head can be adjusted by reciprocating the head along the α, β, and γ directions. The position and orientation of the jet head 20 are accurately controlled by the control device 26 so that the droplet jet surface 20*a* with respect to the substrate P on the stage ST has a predetermined position or orientation. In the droplet jet surface 20*a* of the jet head 20, a plurality of nozzle openings are provided for jetting droplets.

The droplets jetted from the jet head 20 may be droplets which include a material selected from various kinds of material such as (i) ink which includes coloring material, (ii) dispersion liquid which includes dispersed materials such as metal particles, (iii), solution which includes an organic EL material such as material used for hole injection (e.g., oly(3, 4-ethylenedioxythiophene) (PEDOT): poly(styrene sulfonate) (PSS)), or luminescent material, (iv) functional liquid having high viscosity such as liquid crystal material, (v) functional liquid including material for micro lenses, and (vi) biopolymer solution including protein, nucleic acid, or the like.

Figure 2:
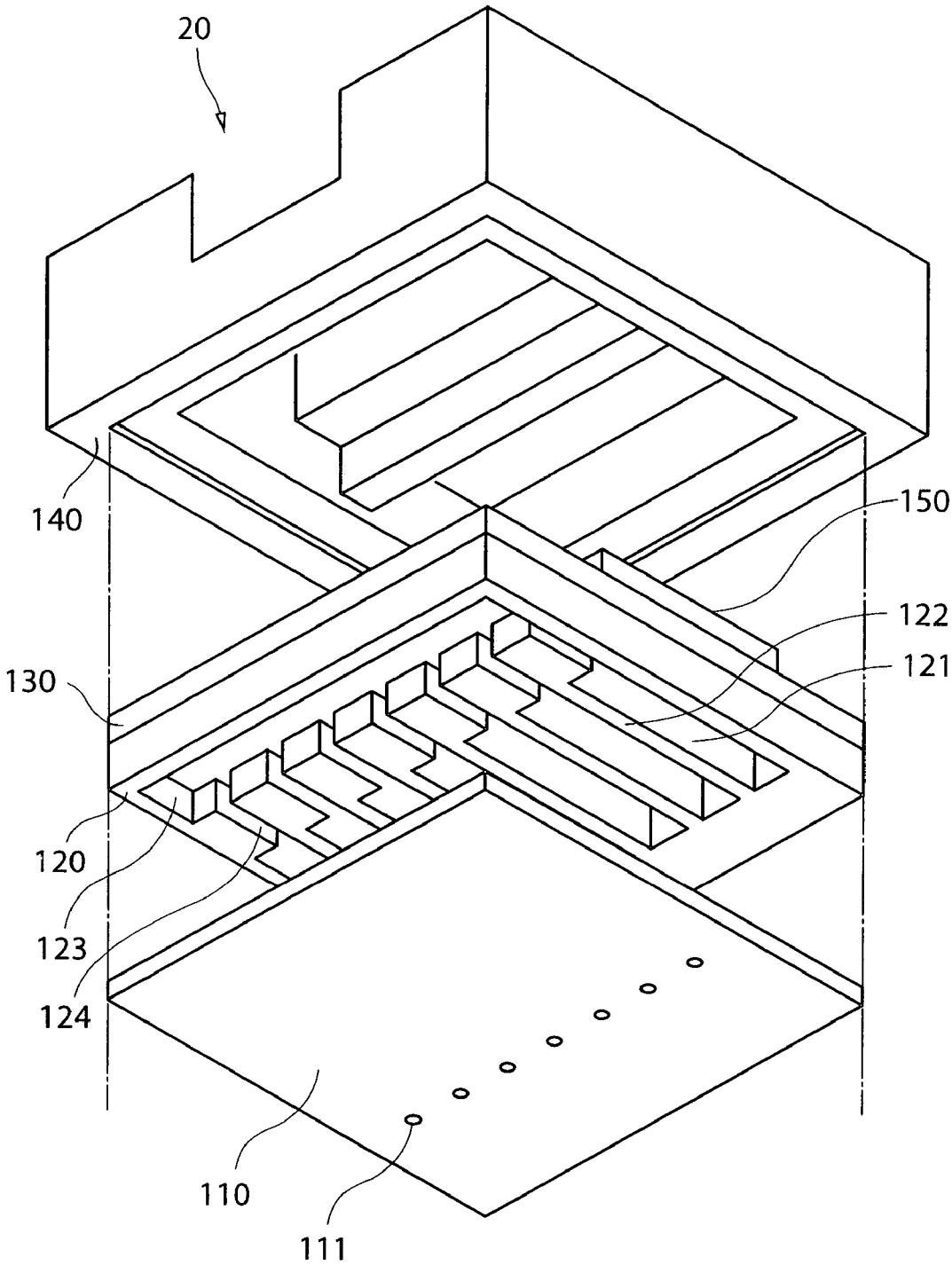
FIG. 2 is an exploded perspective view showing the jet head 20.
Figure 3:
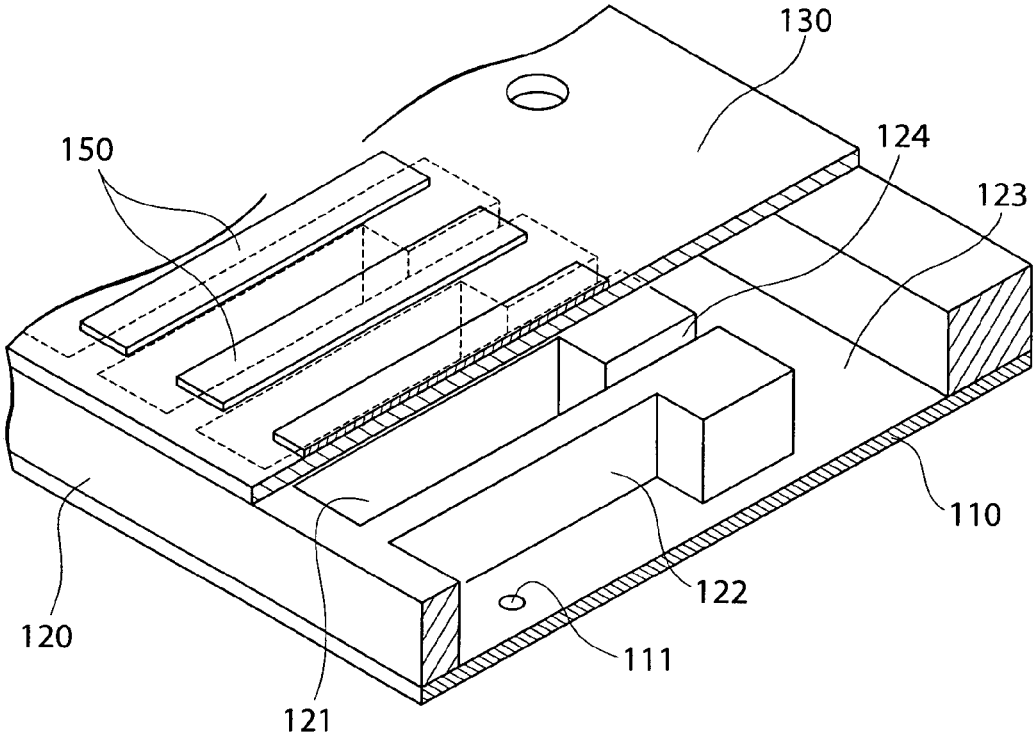
FIG. 3 is a perspective view showing a part of the main component of the jet head 20.

The structure of the jet head 20 will be explained below. FIG. 2 is an exploded perspective view showing the jet head 20. FIG. 3 is a perspective view showing a part of the main component of the jet head 20. The jet head 20 shown in FIG. 2 includes a nozzle plate 110, a pressure chamber substrate 120, a diaphragm 130, and a body 140. As shown in FIG. 2, the pressure chamber substrate 120 has cavities 121, side walls 122, a reservoir 123, and supply inlets 124. The cavities 121 are pressure chambers formed by performing etching of a substrate made of silicon or the like. The side walls 122 are formed as partitions between the cavities 121. The reservoir 123 is formed as a common passage for supplying a predetermined liquid, which is used when the predetermined liquid is supplied to each cavity 121. The predetermined liquid can be drawn into each cavity through the supply inlets 124.

As shown in FIG. 3, the diaphragm 130 can be adhered to a face of the pressure chamber substrate 120. Piezoelectric elements 150, which are elements of the piezoelectric device, are provided on the diaphragm 130. The piezoelectric element 150 is a ferroelectric crystal having the perovskite structure and is formed as a specific shape on the diaphragm 130. The volume of the piezoelectric element 150 can be changed in accordance with a driving signal supplied from the control device 26. The nozzle plate 110 is adhered to the pressure chamber substrate 120 in a manner such that the aligned nozzle openings 111 are respectively positioned to the aligned cavities 121 (i.e., pressure chambers). The pressure chamber substrate 120, to which the nozzle plate 110 is adhered, is contained in the body 140 for forming the jet head 20 (i.e., the droplet jetting head) as shown in FIG. 2.

In order to jet droplets from the jet head 20, first, the control device 26 supplies a driving signal for jetting a droplet to the jet head 20. Here, the predetermined liquid has been drawn into cavities 121 of the jet head 20; thus, when the driving signal is supplied to the jet head 20, the volume of the piezoelectric element 150 provided at the jet head 20 changes in accordance with the driving signal. This volume change deforms the diaphragm 130 and changes the volume of the cavity 121. Accordingly, a droplet is jetted from the nozzle opening 111 of the cavity 121. A new droplet is supplied from the tank 16 to the cavity 121 from which the droplet was jetted.

The jet head 20 explained with reference to FIGS. 2 and 3 has a structure for jetting a droplet by producing changes in volume by using the piezoelectric element 150. However, the head may have a structure including a heating device for heating the predetermined liquid so as to jet the droplets due to expansion of the liquid, or changes in volume may be produced by deformation of the diaphragm caused by static electricity, so as to jet droplets.

Again referring to FIG. 1, the second moving device 14 can selectively position the jet head 20 above the cleaning unit 24 or the capping unit 22 by moving the jet head 20 in the X direction. That is, even in the middle of the device manufacturing process, if the jet head 20 is moved above the cleaning unit 24, cleaning of the jet head 20 can be performed. If the jet head 20 is moved above the capping unit 22, it is possible to perform (i) capping of the droplet jet surface 20*a* of the jet head 20, (ii) filling of the cavities 121 with droplets, (iii) retrieval of substandard jetting due to clogging of the nozzle openings 111, or the like.

That is, the cleaning unit 24 and the capping unit 22 are positioned at the rear portion 10*a* of the base 10 and immediately under the path of the movement of the jet head 20, where the units 24 and 22 are isolated from the stage ST. The carrying-in and carrying-out operations of the substrate P to and from the stage ST are performed at the front portion 10*b* of the base 10; thus, the carrying-in and carrying-out operations are not disturbed by the cleaning unit 24 and the capping unit 22.

The cleaning unit 24 has a wiper for wiping the surface in which the nozzle openings 111 are formed, thereby performing the cleaning of the nozzle openings 111 or the like of the jet head 20 regularly or optionally during the device manufacturing process or in the stand-by state. In order to protect the droplet jet surface 20*a* of the jet head 20 from drying, the capping unit 22 performs capping of the droplet jet surface 20*a* in the stand-by state in which devices are not manufactured. The capping unit 22 is also used when filling the cavities 121 with droplets, or when retrieving the jet head 20 which caused substandard jetting.

Figure 4A:
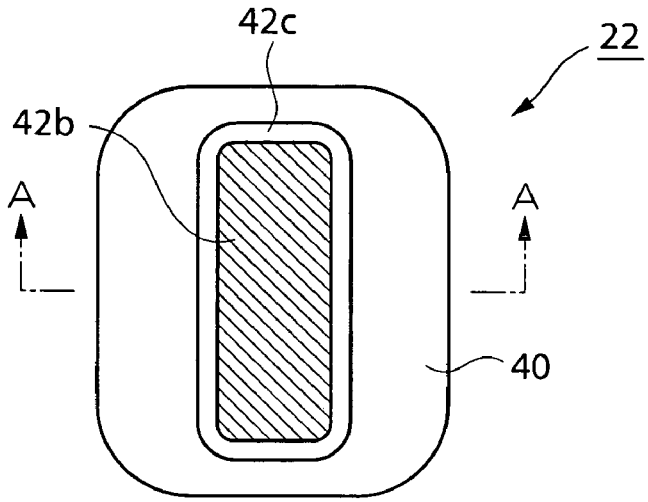
FIG. 4A is plan view of the capping unit 22, observed from the jet head 20.
Figure 4B:
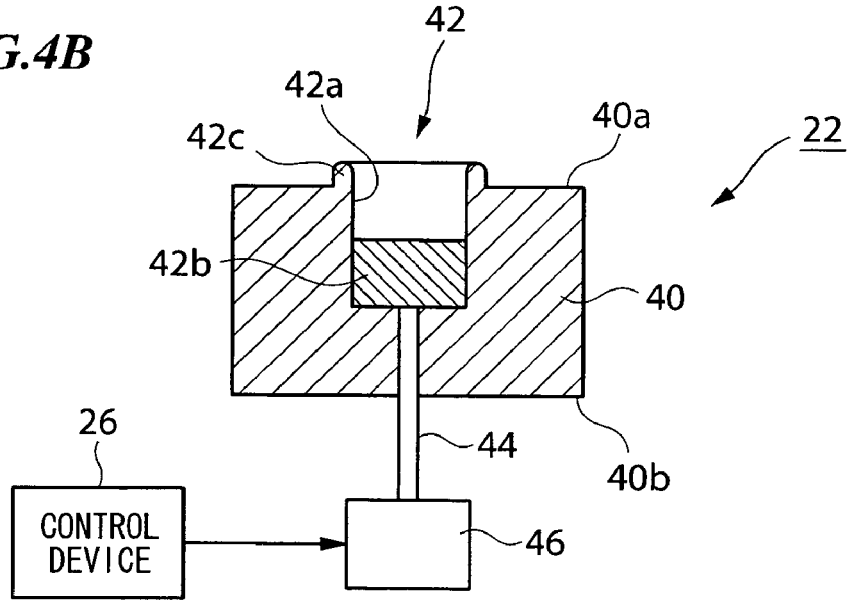
FIG. 4B is a sectional view along line A-A in FIG. 4A.

The capping unit 22 will be explained in detail. FIGS. 4A and 4B are diagrams showing the structure of the capping unit 22. FIG. 4A is plan view of the capping unit 22, observed from the jet head 20, and FIG. 4B is a sectional view along line A-A in FIG. 4A. As shown in FIGS. 4A and 4B, the capping unit 22 includes a main body 40, a capping portion 42, a communication tube 44, and a pump 46 (i.e., a negative pressure supply device).

The capping portion 42 includes a wet member 42*b* inserted in a concave portion 42*a* which is formed in the main body 40, and a protruding portion 42*c* which protrudes from the upper face 40*a* of the main body 40. To the bottom face of the concave portion 42*a*, the communication tube 44 is connected, which passes through the lower face 40*b* of the main body 40. The wet member 42*b* has superior absorption for the droplets jetted from the jet head 20 and keeps the wet state after the droplets are absorbed. The wet member 42*b* may be a sponge material. The pump 46 is used for attracting and decompressing (i.e., supplying negative pressure) the capping unit 42 via the communication tube 44. This pump 46 is electrically connected to the control device 26 and is driven under the control of the control device 26.

Again referring to FIG. 1, the droplet jetting apparatus IJ of the present embodiment has a jet detection device 38 for determining whether there is any nozzle opening 111 (among the nozzle openings 111 provided in the droplet jet surface 20*a* of the jet head 20) from which no droplet is jetted, that is, whether dot loss occurs. The jet detection device 38 may be constructed by a laser light source and a light receiving element for receiving the laser beam from the laser light source. The laser light source and the light receiving element are arranged in a manner such that when the position of the jet head 20 is determined at a predetermined position in the X direction, the locus of the droplet jetted from each nozzle opening 111 passes between the laser light source and the light receiving element. Accordingly, when the droplets are jetted from the nozzle openings 111 in turn, the presence/absence of the dot loss is determined according to a change in the quantity of light received by the light receiving element.

The jet detection device 38 may be constructed by (i) a printing portion where the droplet from each nozzle opening 111 is printed and the printing surface can be cleaned using a wiper or the like, and (ii) an imaging device such as a CCD (charge coupled device), which is optically conjugate with the printing portion by using optical lenses or the like. In this structure, the printing surface is printed by jetting droplets from the nozzle openings 111 and the printing surface is imaged using the imaging device. The obtained image signal is image-processed, thereby determining presence or absence of the dot loss.

Figure 5:
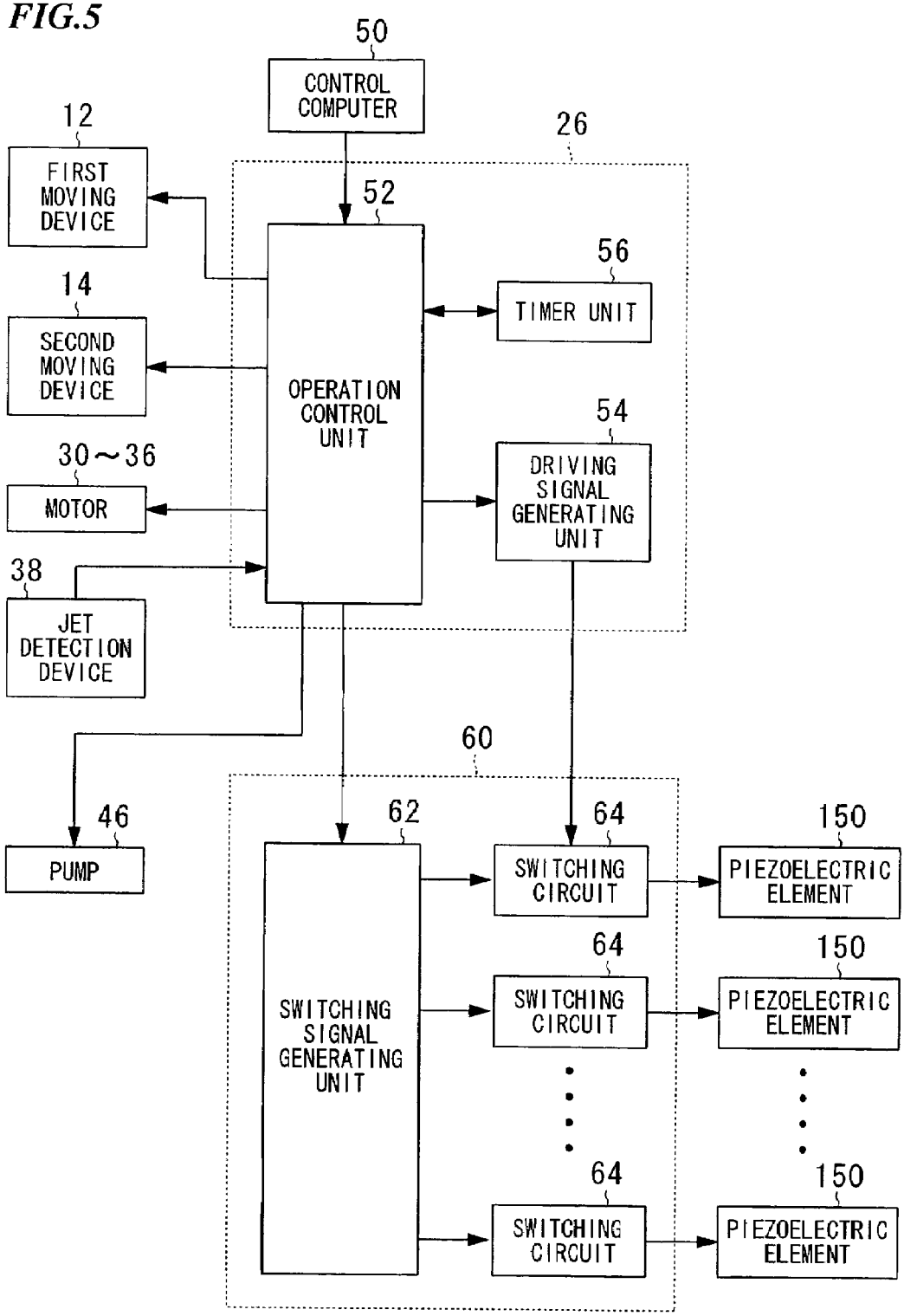
FIG. 5 is a block diagram for showing the electrical function and structure of the droplet jetting apparatus in the embodiment.

The electrical function and structure of the droplet jetting apparatus IJ of the present embodiment will be explained below. FIG. 5 is a block diagram for showing the electrical function and structure of the droplet jetting apparatus IJ. In FIG. 5, blocks corresponding to the members shown in FIGS. 1 to 4 are given identical reference numerals. As shown in FIG. 5, the electrical structure for controlling the droplet jetting apparatus IJ includes a control computer 50, the control device 26, and a driving integrated circuit 60.

The control computer 50 may include a CPU (central processing unit), internal storage devices such as a RAM (random access memory) and a ROM (read only memory), external storage devices such as a hard disk and a CD-ROM, and a display device such as a liquid crystal display, a CRT (cathode ray tube), or the like. According to the program stored in the ROM or the hard disk, the control computer 50 outputs control signals for controlling the droplet jetting apparatus IJ. This control computer 50 is connected to the control device 26 shown in FIG. 1 (which is provided in the droplet jetting apparatus IJ) via, for example, a cable.

The control device 26 includes an operation control unit 52, a driving signal generating unit 54, and a timer unit 56. The operation control unit 52 drives the first moving device 12, the second moving device 14, and the motors 30 to 36 and also controls the operation of the pump 46 provided in the capping unit 22, based on the control signals input from the control computer 50 and the control program which is stored in the operation control unit 52 in advance.

The operation control unit 52 also outputs to the driving signal generating unit 54, various data (i.e., driving signal generating data) for generating driving signals for driving the piezoelectric elements 150, which are provided in the jet head 20. The operation control unit 52 also generates selection data based on the above control program and outputs the data to a switching signal generating unit 62 which is provided in the driving integrated circuit 60. This selection data consists of nozzle selection data for designating a piezoelectric element 150 to which the driving signal is applied, and waveform selection data for designating a driving signal to be applied to the piezoelectric element 150.

The operation control unit 52 also counts the time while the jet head 20 is capped by the capping unit 22 and the time while the jet head 20 is not capped, by using the timer unit 56, and controls the time for driving the pump 46, or the like. Based on the results of detection by the jet detection device 38, the operation control unit 52 controls forced jetting (i.e., flushing) of the droplets from the nozzle openings 111 of the jet head 20, and also controls the capping time, number of times for cleaning, and the like.

Based on the driving signal generating data, the driving signal generating unit 54 generates various kinds of driving signals which have specific forms, and outputs the generated signals to the switching circuit 64. The driving signal generated by the driving signal generating unit 54 may be a normal driving signal, a forced jetting driving signal, and a micro driving signal. The normal driving signal is a driving signal for jetting a predetermined quantity of droplets from the nozzle openings 111, and the forced jetting driving signal is a driving signal for forcedly jetting half of the excluded volume of the liquid from a specific nozzle opening 111. Here, the excluded volume is a volume of the liquid removed from the cavity 121 when the maximum pressure is applied to the cavity 121 by employing the maximum deformation of the piezoelectric element 150.

The micro driving signal is a driving signal for performing micro reciprocation of the piezoelectric element 150 by which no droplet is jetted from the nozzle openings 111, so that the meniscus portion at the nozzle opening 111 is reciprocated, thereby preventing increase in the viscosity of the liquid close to the nozzle opening 111. To the timer unit 56, a counting start signal and counting time output from the operation control unit 52 are input, and the timer unit 56 outputs a counting complete signal when the counting time has eplapsed after the start of the counting.

The driving integrated circuit 60, provided in the jet head 20, includes the switching signal generating unit 62 and the switching circuit 64. The switching signal generating unit 62 generates a switching signal for designating conduction or non-conduction of the driving signal to each piezoelectric element 150 based on the selection data output from the operation control unit 52, and outputs the generated signal to the switching circuit 64. The switching circuit 64 is provided for each piezoelectric element 150 and outputs a driving signal designated by the switching signal to the piezoelectric element 150.

Figure 6A:
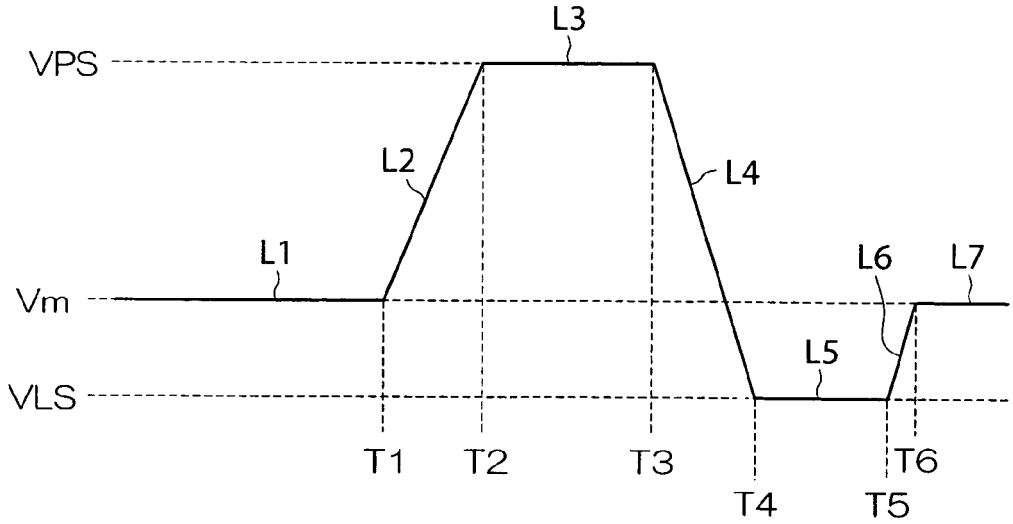
FIG. 6A is a diagram showing a waveform in a single period of the normal driving signal generated by the driving signal generating unit 54.
Figure 6B:
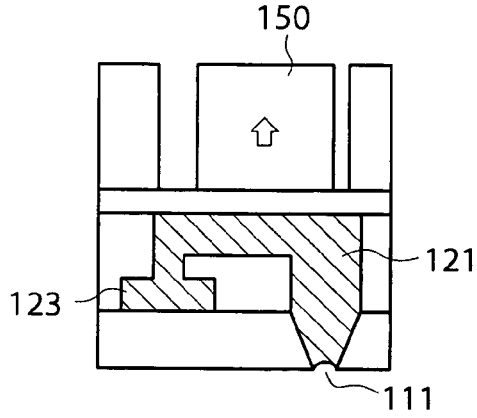
FIGS. 6B to 6D are diagrams showing the general operation of the jet head.
Figure 6D:
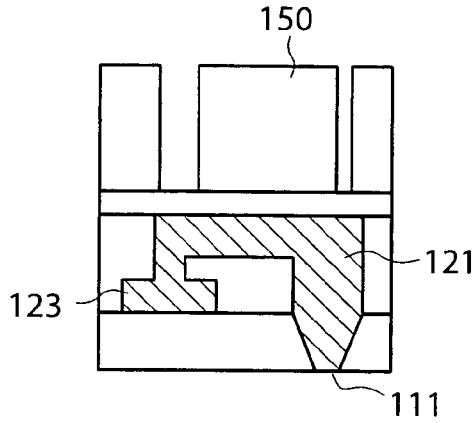
Figure 6C:
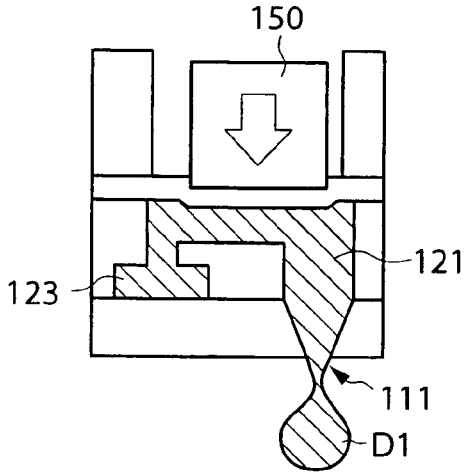

An example of the driving signal generated by the driving signal generating unit 54 and the relevant operation of the jet head 20 will be generally explained. FIG. 6A is a diagram showing a waveform in a single period of the normal driving signal generated by the driving signal generating unit 54, and FIGS. 6B to 6D are diagrams showing the general operation of the jet head. As shown in FIG. 6A, basically, the voltage of the normal driving signal starts from the intermediate electric potential Vm (i.e., hold pulse L1) and then increases with a constant gradient up to the maximum potential VPS from time T1 to T2 (i.e., charge pulse L2). From time T2 to T3, the maximum potential VPS is maintained in a predetermined time (i.e., hold pulse L3). From time T3 to T4, the voltage decreases with a constant gradient to the minimum potential VLS (i.e., discharge pulse L4), and then from time T4 to T5, the minimum potential VLS is maintained in a predetermined time (i.e., hold pulse L5). From time T5 to T6, the voltage again increases to the intermediate potential Vm with a constant gradient (i.e., charge pulse L6).

When the normal driving signal explained above is applied to the piezoelectric element 150, the piezoelectric element 150 operates as shown in FIGS. 6B to 6D, so that the predetermined liquid is jetted as a droplet from the nozzle opening 111. First, from time T1 to T2 (see FIG. 6A), the charge pulse L2, in which the voltage of the normal driving signal gradually increases, is applied to the piezoelectric element 150, the element 150 bends towards a direction by which the volume of the cavity 121 gradually increases (see FIG. 6B), so that negative pressure is produced in the cavity 121. Accordingly, the predetermined liquid is supplied from the reservoir 123 to the cavity 121. As shown in FIG. 6B, the viscous liquid material positioned in the neighborhood of the nozzle opening 111 is also slightly attracted towards the inside of the cavity 121, so that the meniscus portion is attracted towards the inside of the cavity 121.

From time T2 to T3, the hold pulse L3 for maintaining the voltage of the normal driving signal at the maximum potential VPS is applied to the piezoelectric element 150, and from time T3 to T4, the discharge pulse L4 is applied to the piezoelectric element 150. Accordingly, the piezoelectric element 150 bends towards a direction by which the volume of the cavity 121 is rapidly decreased, so that positive pressure is produced in the cavity 121. Accordingly, as shown in FIG. 6C, the predetermined liquid is jetted from the nozzle opening 111 as droplet D1.

After the droplet D1 is jetted, from time T4 to T5, the hold pulse L5 for maintaining the minimum potential VLS is applied to the piezoelectric element 150, and then from time T5 to T6, the charge pulse L6, whose voltage increases up to the intermediate potential Vm with a constant gradient. When the charge pulse L6 is applied to piezoelectric element 150, the element 150 deforms so as to produce negative pressure in the cavity 121 (see FIG. 6D). Accordingly, the predetermined liquid is supplied from the reservoir 123 to the cavity 121. Simultaneously, the predetermined liquid in the neighborhood of the nozzle opening 111 is slightly attracted towards the inside of the cavity 121, so that a fixed shape of the meniscus portion is maintained (see FIG. 6D). Therefore, the higher the maximum potential VPS or the steeper the gradient of the discharge pulse L4, the greater the weight of the viscous liquid material (jetted from the nozzle opening 111) per dot.

Figure 7A:
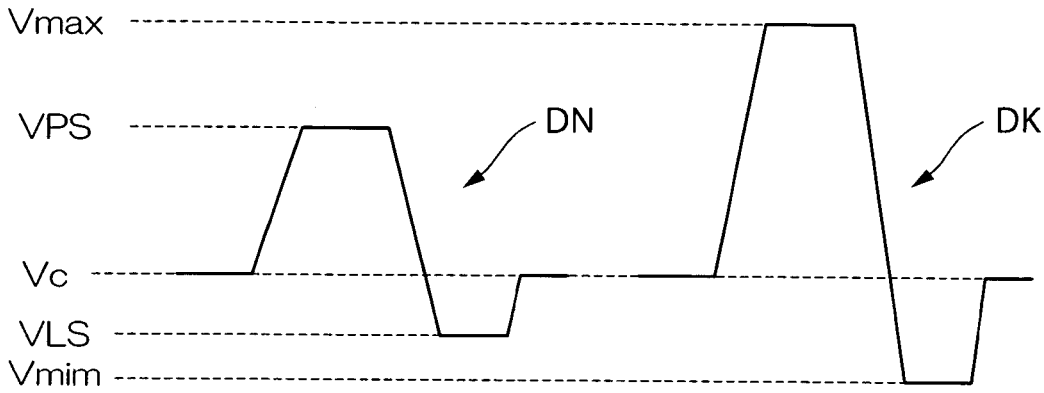
FIGS. 7A and 7B are diagrams for explaining the normal driving signal, the forced jetting driving signal, and the excluded volume.
Figure 7B:
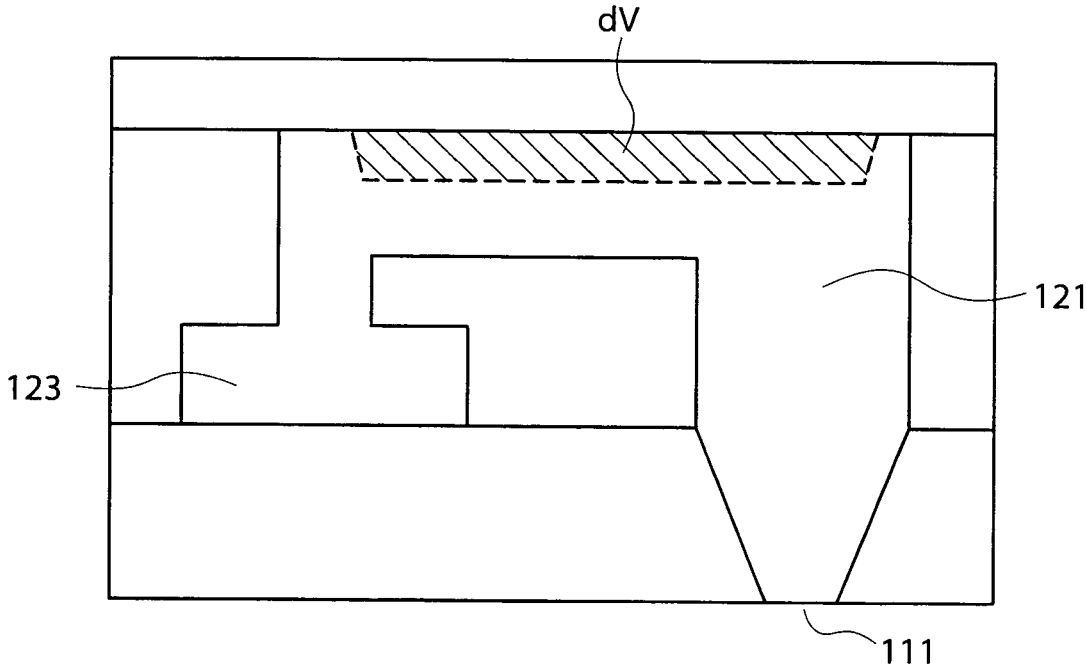

Hereinbelow, the normal driving signal and the forced jetting driving signal are compared with each other. FIGS. 7A and 7B are diagrams for explaining the normal driving signal, the forced jetting driving signal, and the excluded volume. FIG. 7A shows the normal driving signal and the forced jetting driving signal, and FIG. 7B shows the excluded volume. In FIG. 7A, the driving signal indicated by reference symbol DN is the normal driving signal, and the driving signal indicated by reference symbol DK is the forced jetting driving signal. The normal driving signal DN is a driving signal whose voltage varies between the maximum potential VPS and the minimum potential VLS. The forced jetting driving signal DK is a driving signal whose voltage varies between the potential Vmax and the potential Vmin, where the potential Vmax is higher than the maximum potential VPS of the normal driving signal DN, and the potential Vmin is lower than the minimum potential LVS of the normal driving signal. Here, the potential Vmax is set to a value by which deformation of the piezoelectric element 150 is maximum, and the potential Vmin and the potential Vc are set to values by which the above deformation can be retrieved.

That is, when the forced jetting driving signal Dk is applied to the piezoelectric element 150, the piezoelectric element 150 is subjected to the maximum deformation, and accordingly, the change in volume of the cavity 121 is maximum. The quantity of the maximum change of the cavity 121 is the excluded volume. When forced jetting driving signal DK is applied to the piezoelectric element 150, the jet head 20 performs operations similar to those shown in FIGS. 6B to 6D, except for the magnitude of deformation of the piezoelectric element 150. In FIG. 7B, the portion indicated by reference symbol dV (i.e., the hatched portion) corresponds to the excluded volume which is the maximum quantity of the volume of the liquid excluded from the cavity 121 at a time. Here, the cavity 121 is not enclosed except for the nozzle opening 111 and communicates with the reservoir 123 via the supply inlet 124 (see FIGS. 2 and 3); thus, half of the excluded volume dV is drawn into the reservoir 123, so that the maximum quantity of the liquid jetted from the nozzle opening 111 at a time is half the excluded volume dV.

Figure 8A:
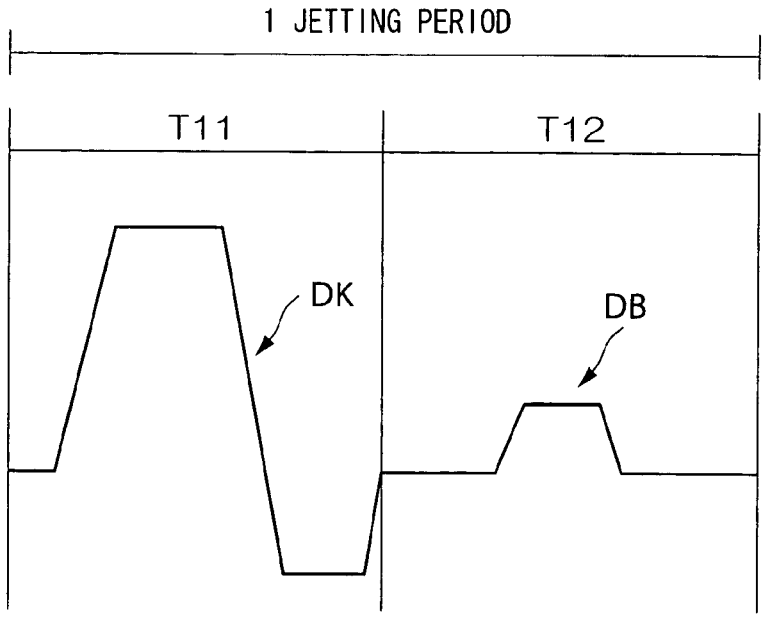
FIGS. 8A and 8B are diagrams showing the forced jetting driving signal and the micro driving signal.
Figure 8B:
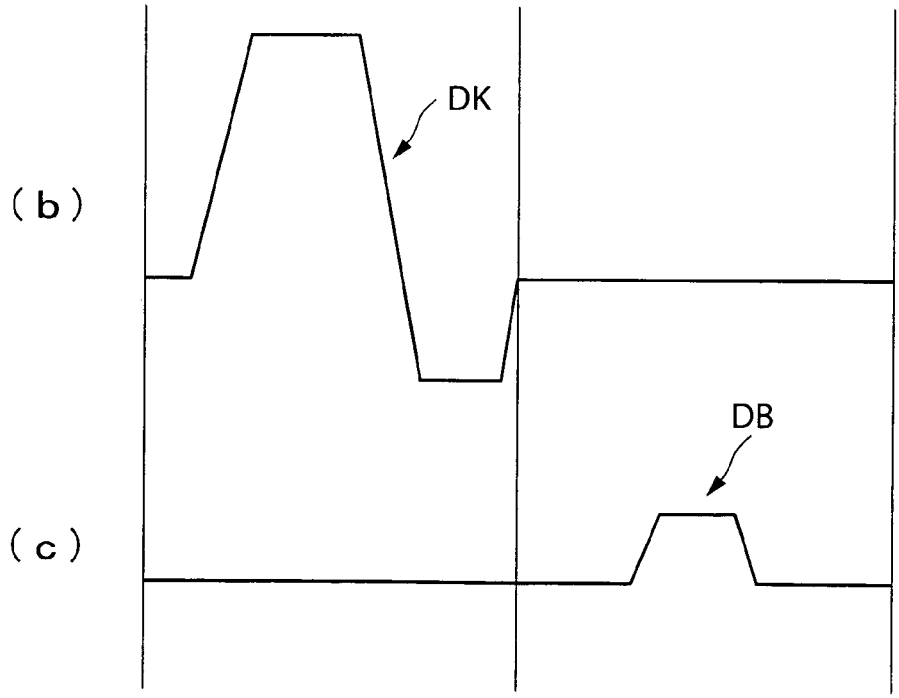

The micro driving signal will be explained below. FIGS. 8A and 8B are diagrams showing the forced jetting driving signal and the micro driving signal. As shown in FIG. 8A, the driving signal generating unit 54 generates a driving signal which includes the forced jetting driving signal DK and the micro driving signal DB in one jetting period. The driving signal including the forced jetting driving signal DK and the micro driving signal DB is generated in the driving signal generating unit 54 when clogging in the nozzle opening of the jet head 20 is removed.

As shown in FIG. 8A, one jetting period is divided into period T11 and period T12. The forced driving signal is present in the period T1 while the micro driving signal is present in the period T12. In order to remove clogging of the nozzle opening of the jet head 20, a driving signal including the forced jetting driving signal DK and the micro driving signal DB is generated; thus, the forced jetting driving signal DK and the micro driving signal DB are selected according to the waveform selection data which is included in the selection data output from the operation control unit 52.

Generally (detailed explanations will be provided below), regarding the piezoelectric element 150 corresponding to the nozzle opening for which substandard jetting has been detected by the jet detection device 38, the forced jetting driving signal DK is selected (see part (b) in FIG. 8B), and the selected signal is applied to the piezoelectric element 150 which corresponds to that nozzle opening 111. Conversely, regarding the piezoelectric element 150 provided in the nozzle opening through which jetting is normally performed, the micro driving signal DB is selected (see part (c) in FIG. 8B), and the selected signal is applied to the piezoelectric element 150 which corresponds to that nozzle opening 111.

Method of Driving Droplet Jetting Head

Figure 9:
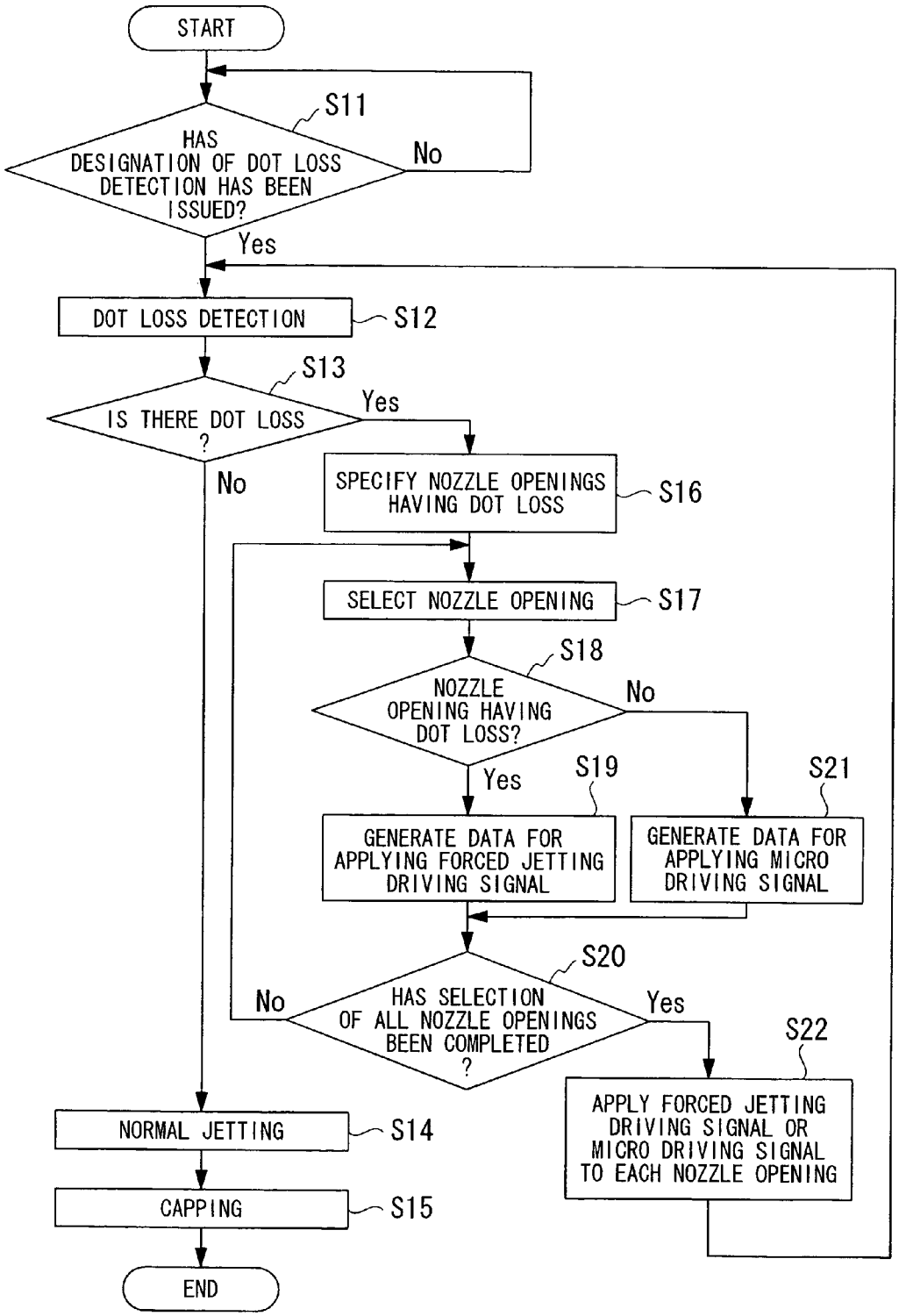
FIG. 9 is a flowchart showing an example of the method of driving the droplet jetting head as an embodiment of the present invention.

Hereinbelow, the method for forming a microarray on the substrate P by using the droplet jetting apparatus IJ having the above-explained structure will be explained, and the method of driving the droplet jetting head performed in the microarray forming process will be explained in detail. FIG. 9 is a flowchart showing an example of the method of driving the droplet jetting head as an embodiment of the present invention.

In the flowchart of FIG. 9, when the operation starts, the operation control unit 52 determines whether a designation for performing dot loss detection has been issued (see step S11). The designation of the dot loss detection is output (i) from the control computer 50 when the power supply of the droplet jetting apparatus IJ is switched on, or (ii) through the program in the operation control unit 52 when the droplet jetting is started or the substrate P is exchanged. The designation of the dot loss detection is also output from the control computer 50 when the operator of the control computer 50 manually designates the computer 50. If there is no designation of the dot loss detection (i.e., NO in step S11), the step S11 is repeated until the designation of the dot loss detection is detected.

If it is determined in step S11 that the designation of the dot loss detection has been issued (i.e., YES in step S11), the operation control unit 52 drives the second moving device 14 so as to move and position the jet head 20 in a manner such that the nozzle openings 111 are positioned above the jet detection device 38 (i.e., in +Z direction). After the positioning of the jet head 20 is completed, the operation control unit 52 outputs the driving signal generating data to the driving signal generating unit 54 so as to generate the normal driving signal DN, and also outputs the selection data to the switching signal generating unit 62.

Based on the selection data from the operation control unit 52, a switching signal for indicating conduction/non-conduction of the driving signal to each piezoelectric element 150 is generated in the switching signal generating unit 62, and the normal driving signal DN, indicated by the switching circuit 64 via the switching signal, is applied to the piezoelectric element 150. Accordingly, droplets are jetted from a plurality of the nozzle openings of the jet head 20 in turn, and dot loss detection is performed in the jet detection device 38 (see step S12).

After the dot loss detection is completed, the detected results are output to the operation control unit 52, and the operation control unit 52 determines presence or absence of dot loss (see step S13). If it is determined that there is no dot loss (i.e., NO in step S13), normal droplet jetting is performed (see step S14). That is, the operation control unit 52 controls the first moving device 12 so as to move the substrate P to the starting position of the movement and also controls the second moving device 14 and the like so as to move the jet head 20 to the starting position for jetting. In addition, the operation control unit 52 respectively outputs the driving signal generating data and the selection data to the driving signal generating unit 54 and the switching signal generating unit 62, so that the normal driving signal DN is applied to each piezoelectric element 150 and droplet jetting to the substrate P is started.

When the droplet jetting is started, the operation control unit 52 performs relative movement (or scanning) between the jet head 20 and the substrate P in the X direction and simultaneously makes predetermined nozzles of the jet head 20 jet droplets in a predetermined width. Through the above operation, a microarray is formed on the substrate P. In the present embodiment, jetting operation is performed while the jet head 20 is moved in the +X direction with respect to the substrate P. After the first turn of the relative movement (or scanning) between the jet head 20 and the substrate P, the stage ST for supporting the substrate P is moved with respect to the jet head 20 by step (i.e., by a predetermined step length) in the Y direction. The operation control unit 52 then performs jetting operation while performing the second relative movement (or scanning) of the jet head 20 with respect to the substrate P, for example, in the −X direction. When repeating such operation several times, the jet head 20 jets droplets based on the control of the operation control unit 52, thereby forming a microarray on the substrate.

When the microarray is completed on the substrate P through the above-explained operation, the operation control unit 52 controls the first moving device 12 so as to move the substrate P, on which the droplets were jetted, to the carry-out position. Accordingly, the attraction and holding by the stage ST is released and the substrate P is carried out from the stage ST by a transfer system (not shown). While the substrate P is carried out from the stage ST, the operation control unit 52 controls the second moving device 14 so as to move the jet head 20 in the X direction and position the head above the capping unit 22. The operation control unit 52 also moves the jet head 20 in the Z direction so as to make the head contact the capping unit 22, thereby performing the capping operation of the jet head 20 (see step S15). According to the above operation, droplet jetting operation for a substrate P is completed.

If it is determined in step S13 that dot loss has been detected (i.e., YES in step S13), the operation control unit 52 performs operation for specifying each nozzle opening which has the dot loss among the nozzle openings formed in the jet head 20, based on the detected results from the jet detection device 38 (see step S16). In parallel to this process, the operation control unit 52 drives the second moving device 14 so as to move and position the jet head 20 in a manner such that the nozzle openings 111 are positioned above the capping unit 22 (i.e., to +Z direction).

After the specification of the nozzle openings 111 which have dot loss and the movement of the jet head 20 are completed, the operation control unit 52 performs a process for removing the dot loss. In this process, the forced jetting driving signal DK is applied to the piezoelectric element 150 corresponding to each nozzle opening 111 which has dot loss, so that liquid of half of the excluded volume is forcedly jetted from the nozzle opening 111, thereby removing clogging of the nozzle opening 111. In order to perform the above process, the operation control unit 52 generates nozzle selection data for selecting each of the nozzle openings 111 formed in the jet head 20 in turn and also generates waveform selection data for making the forced jetting driving signal DK forcedly apply to the piezoelectric element 150 to each nozzle opening 111 specified in step S16.

More specifically, the operation control unit 52 first specifies the first nozzle opening 111 from among the nozzle openings 111 and generates nozzle selection data for selecting this nozzle opening 111 (see step S17). Here, serial nozzle numbers are respectively assigned to the nozzle openings and the operation control unit 52 refers to the nozzle numbers so as to manage and specify each nozzle opening 111. According to the results of specification in step S16, the operation control unit 52 determines whether the selected nozzle opening 111 is a nozzle opening having dot loss (see step S18).

If it is determined that the presently-selected nozzle opening 111 is a nozzle opening having dot loss (i.e., YES in the determination), the operation control unit 52 generates wavelength selection data for applying the forced jetting driving signal DK to the piezoelectric element 150 corresponding to the nozzle opening 111 (see step S19). After this step, operation control unit 52 determines whether selection of all nozzle openings 111 has been completed (see step S20). If it is determined that selection of all nozzle openings has not yet been completed (i.e., NO in the determination), the operation returns to step S17, so as to specify the next nozzle opening 111 and generate nozzle selection data to select this nozzle opening.

If the operation control unit 52 determines in step S18 that the selected nozzle opening 111 has no dot loss (i.e., NO in the determination), the operation control unit 52 generates wavelength selection data for applying the micro driving signal DB to the piezoelectric element 150 corresponding to the nozzle opening 111 (see step S21). After this step, the operation control unit 52 determines whether selection of all nozzle openings 111 has been completed (see step S20). If it is determined that the selection has not yet been completed (i.e., NO in the determination), the operation returns to step S17, so as to specify the next nozzle opening 111 and generate nozzle selection data to select this nozzle opening. The above-explained process is repeated so as to generate nozzle selection data for selecting one of the nozzle openings 111 in turn and also generate waveform selection data for applying the forced jetting driving signal DK or the micro driving signal BK.

If it is determined in step S20 that selection of all nozzle opening 111 has been completed (i.e., YES in the determination), the driving signals and selection data are output to the driving integrated circuit 60 provided in the jet head 20, so that the liquid of half of the excluded volume is forcedly jetted from the nozzle opening 111 having dot loss, thereby removing clogging or the like (see step S22).

When the above process starts, the operation control unit 52 outputs to the driving signal generating unit 54 driving signal generating data for generating a driving signal which includes the forced jetting driving signal DK and the micro driving signal DB in one jetting period as shown in FIG. 8A. When the driving signal generating data is output from the operation control unit 52 to the driving signal generating unit 54, a driving signal as shown in FIG. 8A is output from the driving signal generating unit 54 to the switching circuit 64.

The operation control unit 52 outputs selection data including nozzle selection data and wavelength selection data to the switching signal generating unit 62. When the selection data is output from the operation control unit 52 to the switching signal generating unit 62, (i) a switching signal for designating conduction/non-conduction of the driving signal for each piezoelectric element 150 and (ii) a selection signal for selecting one of the forced jetting driving signal DK and the micro driving signal DB, are generated in the switching signal generating unit 62.

According to the switching signal generated in the switching signal generating unit 62, one of the switching circuits 64 is set to be open, so that one piezoelectric element 150 (i.e., nozzle opening 111) to which the driving signal is to be applied is selected. According to the selection signal generated in the switching signal generating unit 62, one of the forced jetting driving signal DK and the micro driving signal DB shown in FIG. 8A is selected. That is, when the nozzle opening 111 having dot loss is selected by the above switching signal, the forced jetting driving signal DK is selected. When the nozzle opening 111 having no dot loss is selected by the above switching signal, the micro driving signal DB is selected. The selected driving signal is applied from the switching circuit 64, which is set to be open by the switching signal, to the piezoelectric element 150. Accordingly, liquid of half of the excluded volume is forcedly jetted from the nozzle opening 111 having dot loss, while micro reciprocation of the meniscus portion is performed in the nozzle opening 111 having no dot loss.

After that, according to the next selection data output from the operation control unit 52, the nozzle opening 111 and the driving signal are selected, and a selected driving signal is applied to the piezoelectric element 150 corresponding to the selected nozzle opening 111, thereby performing forced jetting of liquid having half of the excluded volume or micro reciprocation of the meniscus portion. The above process is repeated for each of the nozzle openings 111 formed in the jet head 20. After the process in step S22 is completed, the operation returns to step S12 and dot loss detection is again performed. If there is no dot loss, normal jetting is performed (see step S14). Conversely, if dot loss still remains, the processes from step S16 to S22 are performed.

As explained above, in the present embodiment, the forced jetting driving signal DK for making the nozzle opening having dot loss jet a droplet having half of the excluded volume is applied to the piezoelectric element 150 corresponding to the nozzle opening 111 which performed substandard jetting, so as to forcedly jet the liquid inside the cavity 121. Therefore, clogging of the nozzle opening 111 of the jet head 20 (i.e., the droplet jetting head) can be effectively removed. In addition, clogged nozzle opening 111 can be rapidly cleared, thereby reducing the number of times of cleaning of the jet head 20 using the cleaning unit 24. Therefore, degradation in performance of the droplet jetting head, such as reduction in repellency of the liquid, does not occur.

In the present embodiment, the forced jetting driving signal DK is applied to the piezoelectric element 150 corresponding to the nozzle opening 111 which performed substandard jetting, so as to forcedly jet half of the excluded volume, and the micro driving signal DB is applied to the piezoelectric element 150 corresponding to the nozzle opening 111 which performed no substandard jetting, so as to jet no droplet and reciprocate the meniscus portion. Therefore, no droplet of liquid is jetted from the nozzle opening 111 without fault, thereby preventing useless consumption of the liquid. Additionally, reciprocation of the meniscus portion can prevent increase in viscosity of the liquid, thereby preventing clogging of the nozzle opening 111.

In the above-explained embodiment, the forced jetting driving signal DK is applied to the piezoelectric element 150 corresponding to the nozzle opening 111 with a fault in jetting, one at a time, so as to perform forced jetting of the liquid of half of the excluded volume only one time. However, according to the kind of the liquid (e.g., difference in viscosity), or the like, the forced jetting driving signal is applied several times to the piezoelectric element 150 corresponding to the nozzle opening having fault in jetting, so as to forcedly jet a droplet several times.

Also in the above embodiment, the droplet is forcedly jetted from the nozzle opening 111 having fault in jetting while the jet head 20 is positioned above the capping unit 22. However, it is not necessary to perform forced jetting of droplets towards the capping unit 22, and a specific area for jetting droplets may be provided on the stage ST (i.e., flushing area) and droplets may be forcedly jetted onto the flushing area.

Device Manufacturing Method and Electronic Device

The capping device and the control method thereof, and the droplet jetting apparatus, as embodiments of the present invention, have been explained above. The droplet jetting apparatus can be used as a film forming apparatus for forming films, a wiring apparatus for forming wiring such as metal wiring, or a device manufacturing apparatus for manufacturing devices such as micro-lens arrays, liquid crystal devices, organic EL devices, plasma display devices, or field emission displays (FEDs).

Clogging of the nozzle opening 111 is removed using the above-explained droplet jetting apparatus and droplets are jetted onto the substrate P by using the jet head 20 which was subjected to the process for removing the clogging. Therefore, useless consumption of the droplet medium can be prevented and sufficient or longer time for jetting droplets for pattern formation can be secured. Accordingly, the cost for manufacturing devices can be reduced and the throughput can be improved.

The above-explained devices such as liquid crystal displays, organic EL devices, plasma display devices, or FEDs are provided in electronic devices such as notebook computers or cellular phones. However, the electronic devices are not limited to the notebook computers or the cellular phones, and the above-explained devices may be applied to various kinds of electronic devices such as liquid crystal projectors, personal computers (PCs) accommodating multimedia, engineering workstations (EWSs) accommodating multimedia, pagers, word processors, televisions, video tape recorders having a viewfinder or a direct-view monitor, electronic (or personal) organizers, electronic desktop calculators, car navigation devices, POS terminals, or devices having a touch panel.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A method of driving a droplet jetting head which has cavities for containing a predetermined liquid, piezoelectric elements, each for generating pressure in each cavity in accordance with an applied driving signal, and nozzle openings, from each of which the liquid compressed by each piezoelectric element is jetted as a droplet, the method comprising:

a driving step of driving the droplet jetting head by applying to one or more of the piezoelectric elements corresponding to the nozzle openings which cannot jet a droplet by a normal signal form of the driving signal, a forced jetting driving signal having an enlarged signal form for forcedly jetting the liquid of half of an excluded volume from the nozzle opening, wherein the excluded volume is a maximum quantity removable from the cavity by compression using the piezoelectric element; and a control step of applying to the other piezoelectric elements to which the forced jetting driving signal is not applied, a micro driving signal for generating micro pressure by which no droplet is jetted from the nozzle opening corresponding to each of the other piezoelectric elements, wherein the driving step of driving the droplet jetting head by applying the forced jetting driving signal and the control step of applying the micro driving signal are performed in parallel, and wherein the forced jetting driving signal is applied to those individual nozzles which cannot jet a droplet by a normal signal form of the driving signal and the micro driving signal is applied to those individual nozzles to which the forced jetting driving signal is not applied.

2. A method as claimed in claim 1, further comprising:

a detection step of determining whether each nozzle opening can jet a droplet by the normal signal form of the driving signal, wherein:

the control step includes determining whether the forced jetting driving signal is applied to the piezoelectric element of each nozzle opening, according to results in the detection step.

3. A method as claimed in claim 2, wherein the control step includes:

generating a driving signal which includes the forced jetting driving signal and the micro driving signal in one jetting period; and selecting one of the forced jetting driving signal and the micro driving signal according to the detection results in the detection step, and applying the selected signal to the piezoelectric element of each nozzle opening.

4. A method as claimed in claim 2, wherein the control step includes controlling the number of times of application of the forced jetting driving signal to the piezoelectric element, in accordance with the kind of the predetermined liquid.

5. A method of driving a droplet jetting head which has piezoelectric elements, each for generating pressure in accordance with an applied driving signal, and nozzle openings, from each of which a liquid compressed by the pressure generated by each of the piezoelectric elements is jetted as a droplet, the method comprising:

a detection step of determining whether each nozzle opening can jet a droplet by a normal signal form of the driving signal; and a control step of determining whether a forced jetting driving signal having an enlarged signal form for forcedly jetting the liquid from the nozzle opening is applied to the piezoelectric element of each nozzle opening, according to results in the detection step, wherein:

the control step includes applying to each piezoelectric element to which the forced jetting driving signal is not applied, a micro driving signal for generating micro pressure by which no droplet is jetted from the nozzle opening corresponding to said each piezoelectric element; and the application of the micro driving signal is performed in parallel to the application of the forced jetting driving signal, and wherein the forced jetting driving signal is applied to those individual nozzles which cannot jet a droplet by a normal signal form of the driving signal and the micro driving signal is applied to those individual nozzles to which the forced jetting driving signal is not applied.

6. A method as claimed in claim 5, wherein the control step includes:

generating a driving signal which includes the forced jetting driving signal and the micro driving signal in one jetting period; and selecting one of the forced jetting driving signal and the micro driving signal according to the detection results in the detection step, and applying the selected signal to the corresponding piezoelectric element.

7. A method as claimed in claim 5, wherein the control step includes controlling the number of times of application of the forced jetting driving signal to the piezoelectric element, in accordance with the kind of the predetermined liquid.

8. A droplet jetting apparatus having a droplet jetting head which includes cavities for containing a predetermined liquid, piezoelectric elements, each for generating pressure in each cavity in accordance with an applied driving signal, and nozzle openings, from each of which the liquid compressed by each piezoelectric element is jetted as a droplet, the apparatus comprising:

a detection device for determining whether each nozzle opening can jet a droplet by a normal signal form of the driving signal;

a driving signal generating unit for generating driving signals which include:

a forced jetting driving signal having an enlarged signal form for forcedly jetting the liquid of half of an excluded volume from the nozzle opening, wherein the excluded volume is a maximum quantity removable from the cavity by compression using the piezoelectric element; and a micro driving signal for generating micro pressure by which no droplet is jetted; and a control unit for determining to which piezoelectric element the forced jetting driving signal is applied, and to which piezoelectric element the micro driving signal is applied, according to results by the detection device, wherein the forced jetting driving signal and the micro driving signal are applied in parallel, and wherein the forced jetting driving signal is applied to those individual nozzles which cannot jet a droplet by a normal signal form of the driving signal and the micro driving signal is applied to those individual nozzles to which the forced jetting driving signal is not applied.

9. A droplet jetting apparatus as claimed in claim 8, wherein the control unit selects one of the forced jetting driving signal and the micro driving signal according to the detection results by the detection device, and applies the selected signal to the corresponding piezoelectric element.

10. A device manufacturing method for manufacturing a device which includes a work on which a functional pattern is formed in a predetermined area, the method comprising:

a preliminary jetting step performed using the method as claimed in claim 1 or using the droplet jetting apparatus as claimed in claim 8, wherein the predetermined liquid is jetted from the nozzle openings of the droplet jetting head which cannot jet a droplet by the normal signal form of the driving signal; and a pattern forming step of forming the pattern on the work by jetting the droplets by using the droplet jetting head which was subjected to the preliminary jetting step.

* * * * *